US007802678B2

(12) United States Patent
Juneau

(10) Patent No.: US 7,802,678 B2
(45) Date of Patent: Sep. 28, 2010

(54) DEVICE FOR A CONTAINER

(76) Inventor: Claude Juneau, 2900, chemin Vallée, St-Alexis-des-Monts, Québec (CA) J0K 1V0

( * ) Notice: Subject to any disclaimer, the term of this patent is extended or adjusted under 35 U.S.C. 154(b) by 1094 days.

(21) Appl. No.: 10/552,239

(22) PCT Filed: Apr. 8, 2004

(86) PCT No.: PCT/CA2004/000548

§ 371 (c)(1),
(2), (4) Date: Dec. 20, 2005

(87) PCT Pub. No.: WO2004/089781

PCT Pub. Date: Oct. 21, 2004

(65) Prior Publication Data

US 2006/0213788 A1 Sep. 28, 2006

(30) Foreign Application Priority Data

Apr. 10, 2003 (CA) ..... 2424536

(51) Int. Cl.
*B67D 5/00* (2006.01)

(52) U.S. Cl. ..... 206/222; 222/82

(58) Field of Classification Search ..... 206/222, 206/221, 219, 568; 222/129, 145, 145.5, 222/541.2, 541.6, 80, 87, 94, 142.5, 207; 220/568, 578, 579, 495.03, 502, 62.12, 906
See application file for complete search history.

(56) References Cited

U.S. PATENT DOCUMENTS 3,039,644 A 6/1962 Lefcort
3,255,926 A * 6/1966 Modderno ..... 222/136
3,305,368 A 2/1967 Bourelle
3,718,235 A * 2/1973 Cronan ..... 222/136
3,743,520 A 7/1973 Croner
3,779,372 A 12/1973 de Lloret
4,088,246 A * 5/1978 Klingaman ..... 222/88
4,264,007 A 4/1981 Hunt
4,333,581 A 6/1982 Flansburg
4,491,250 A * 1/1985 Liebermann ..... 222/386.5
4,614,267 A * 9/1986 Larkin ..... 206/221
4,893,730 A * 1/1990 Bolduc ..... 222/80
5,012,978 A * 5/1991 Bolduc ..... 239/304

(Continued)

FOREIGN PATENT DOCUMENTS

CH 634 007 A5 1/1983

(Continued)

*Primary Examiner*—Ehud Gartenberg
*Assistant Examiner*—Ernesto A Grano
(74) *Attorney, Agent, or Firm*—Fish & Richardson P.C.

(57) ABSTRACT

The device is for a container provided with an opening and a flexible wall. The device comprises at least one tank insertable into the container in operating position; and at least one release mechanism insertable into the container in operating position. The release mechanism is capable of cooperating with the tank in order to connect the tank with the interior of the container in response to a pressure exerted on the release mechanism via the wall of the container. The device comprises also a support element insertable inside the container to support in operating position the tank and the release mechanism in relation to the container. The support element has a fastening to fix it on the container close to the opening.

10 Claims, 8 Drawing Sheets

U.S. PATENT DOCUMENTS

| | | | | | |
|---|---|---|---|---|---|
| 5,246,142 | A | | 9/1993 | DiPalma et al. | |
| 5,330,048 | A | * | 7/1994 | Haber et al. | 206/221 |
| 5,584,165 | A | * | 12/1996 | Wright | 53/432 |
| 5,620,725 | A | * | 4/1997 | Jamieson et al. | 426/112 |
| 5,711,420 | A | | 1/1998 | Spring | |
| 5,885,635 | A | | 3/1999 | Spring et al. | |
| 5,890,624 | A | * | 4/1999 | Klima et al. | 222/82 |
| 5,992,677 | A | | 11/1999 | Ebine | |
| 6,036,005 | A | * | 3/2000 | Krause et al. | 206/221 |
| 6,047,818 | A | | 4/2000 | Warby et al. | |
| 6,173,579 | B1 | | 1/2001 | Davidson | |
| 6,250,346 | B1 | | 6/2001 | Castillo | |
| 6,263,923 | B1 | | 7/2001 | Castillo | |
| 6,364,103 | B1 | * | 4/2002 | Sergio et al. | 206/222 |
| 6,513,650 | B2 | | 2/2003 | Mollstam et al. | |
| 6,543,612 | B2 | | 4/2003 | Lee et al. | |

FOREIGN PATENT DOCUMENTS

| | | |
|---|---|---|
| DE | 86 27 292 U1 | 3/1988 |

* cited by examiner

DEVICE FOR A CONTAINER

CROSS REFERENCE TO PRIOR APPLICATION

This is a U.S. national phase application under 35 U.S.C. §371 of International Patent Application No. PCT/CA2004/000548, filed Apr. 8, 2004, and claims priority of Canadian Patent Application No. 2,424,536, filed Apr. 10, 2003, which is incorporated by reference herein. The International Application was published in French on Oct. 21, 2004 as WO 2004/089781 A1 under PCT Article 21(2).

FIELD OF THE INVENTION

The present invention relates to a device for a container provided with an opening and a flexible wall.

DESCRIPTION OF PRIOR ART

It is known from prior art the U.S. Pat. No. 6,173,579 (DAVIDSON) which shows, on FIGS. 1 and 2, a bottle being able to contain a drink and comprising a sealed compartment as well as means to cause a rupture, from the outside of the bottle, of a bulkhead of the sealed compartment to connect with another sealed compartment of the bottle. According to a preferred embodiment of this invention, the goal is to allow to a compressed coolant contained inside the first sealed compartment to take expansion to cool itself and by the very fact to cool the contents of the bottle. Thus the user can take a bottle directly of a rack at the room temperature and consume a cold drink as if it had been stored inside a refrigerator.

In another preferred embodiment shown on FIGS. 3 and 5 of this patent, the other compartment constitutes the interior of the bottle. In this embodiment, a compartment comprises a gas to gasify the drink contained inside the bottle. In this case, the compartment 61 is filled with gas nitrogen. It is the general shape of a cylinder to adjust itself inside a standard drink bottle with its longitudinal axis aligned with the longitudinal axis of the bottle. The body of the compartment 61 has a flattened part. A projecting part 67 is directed towards this flattened part, and can be actuated from outside of the bottle to break a membrane 69. At the time of the breaking, the nitrogen is spread inside the bottle to gasify the drink.

The U.S. Pat. No. 5,711,420 delivered on Jan. 27, 1998 in the name of Robert E. SPRING describes an apparatus to distribute a substance in a liquid drink. This patent, as illustrated on FIGS. 1 to 5, present an invention relating to the distribution of a substance, including a drug, in a drink inside a container. The proposed system comprises a container 10, a principal compartment 9 and a secondary compartment 90, which are separated by a common sealed wall 92, 94 and a means to cause the rupture of said common wall accessible from outside. The rupture of the common wall 92, 94 allows the mixture of the two products inside the principal compartment 9.

The U.S. Pat. No. 5,885,635 delivered on Mar. 23, 1999 in the name of Robert E. SPRING et al. describes another apparatus to disperse a substance in a liquid drink. The container 10 of this apparatus, as illustrated on FIGS. 1 to 5, comprises a principal compartment 9, a secondary compartment 20 as well as a waterproof common wall between these two compartments. The system also provides a means to cause the rupture of the common wall which is accessible from the outside and which allows to mix the two products together.

The U.S. Pat. No. 6,513,650 B2 delivered on Feb. 4, 2003 in the name of MOLLSTAN et al. describes a container with two compartments. The system comprises a principal compartment 14, a secondary compartment 12, a common wall 18 between the two compartments as well as means 20, 22 to cause the rupture of said common wall 18 accessible from outside to cause the mixture of the two products. While referring to FIGS. 1 and 2, one can notice that the means 20, 22 to cause the rupture of the common wall 18 are found in fact in the cap of the container. On simple pressure of the top of the cap, a blunt object causes the rupture of the secondary compartment to release the secondary product inside the principal product.

The U.S. Pat. No. 3,039,644 delivered on Jun. 19, 1962 in the name of M. LEFCORT describes a container compartmentalized for drinks. The specification of this patent, and more particularly on FIGS. 1, 2, 3 and 4, describes a container 10 composed of a principal compartment (L), of a secondary compartment (G), and of a common wall 15 between the two waterproof compartments as well as a means 20 to cause the rupture of this common wall 15 accessible from outside. The rupture of the common wall 15 will allow mixing the two products together in the principal compartment. This invention aims at storing in two separate portions a basic drink and carbon dioxide being used to give it its sparkling taste.

The U.S. Pat. No. 4,333,581, delivered on Jun. 8, 1982 in the name of Donald G. FLANSBURG, describes a multi-compartmental container. The specification of this patent describes a container comprising a principal compartment 10, a secondary compartment 54 as well as a common waterproof wall 34 separating the two compartments, and a means 24, 28, 44, 46 to perforate the common wall, the means being accessible from outside. The rupture of this common wall will cause the mixture of the two products.

The following patents describe various containers: U.S. Pat. No. 3,305,368; U.S. Pat. No. 3,743,520; U.S. Pat. No. 3,779,372; U.S. Pat. No. 4,264,007; U.S. Pat. No. 5,246,142; U.S. Pat. No. 5,992,677; U.S. Pat. No. 6,250,346 B1; U.S. Pat. No. 6,263,923 B1; U.S. Pat. No. 6,543,612; and CA 1,279,849.

All the aforementioned patents show in general containers which must be modified to make it possible to the user to mix products inside the container.

SUMMARY OF THE INVENTION

The present invention has the aim of proposing a device which adapts easily on a standard container like a bottle or a can, without modification of the container and to allow the user to mix products in the container.

The present invention aims at a device for a container provided with an opening and a flexible wall, the device comprising at least one tank insertable into the container in operating position, at least one release mechanism insertable into the container in operating position said release mechanism being capable of cooperating with the tank in order to connect the tank with the interior of the container in response to a pressure exerted on said release mechanism via the wall of the container, and a support means insertable into the container to support in operating position the tank and the release mechanism in relation to the container, the support means having a fastener to fix the support means on the container close to the opening.

The objects, advantages and other characteristics of this invention will appear more clearly with the reading of the non-restrictive description, which follows, of preferred embodiments, by referring to the annexed drawings.

DETAILED DESCRIPTION OF PREFERRED EMBODIMENTS OF THE INVENTION

Figure 1:
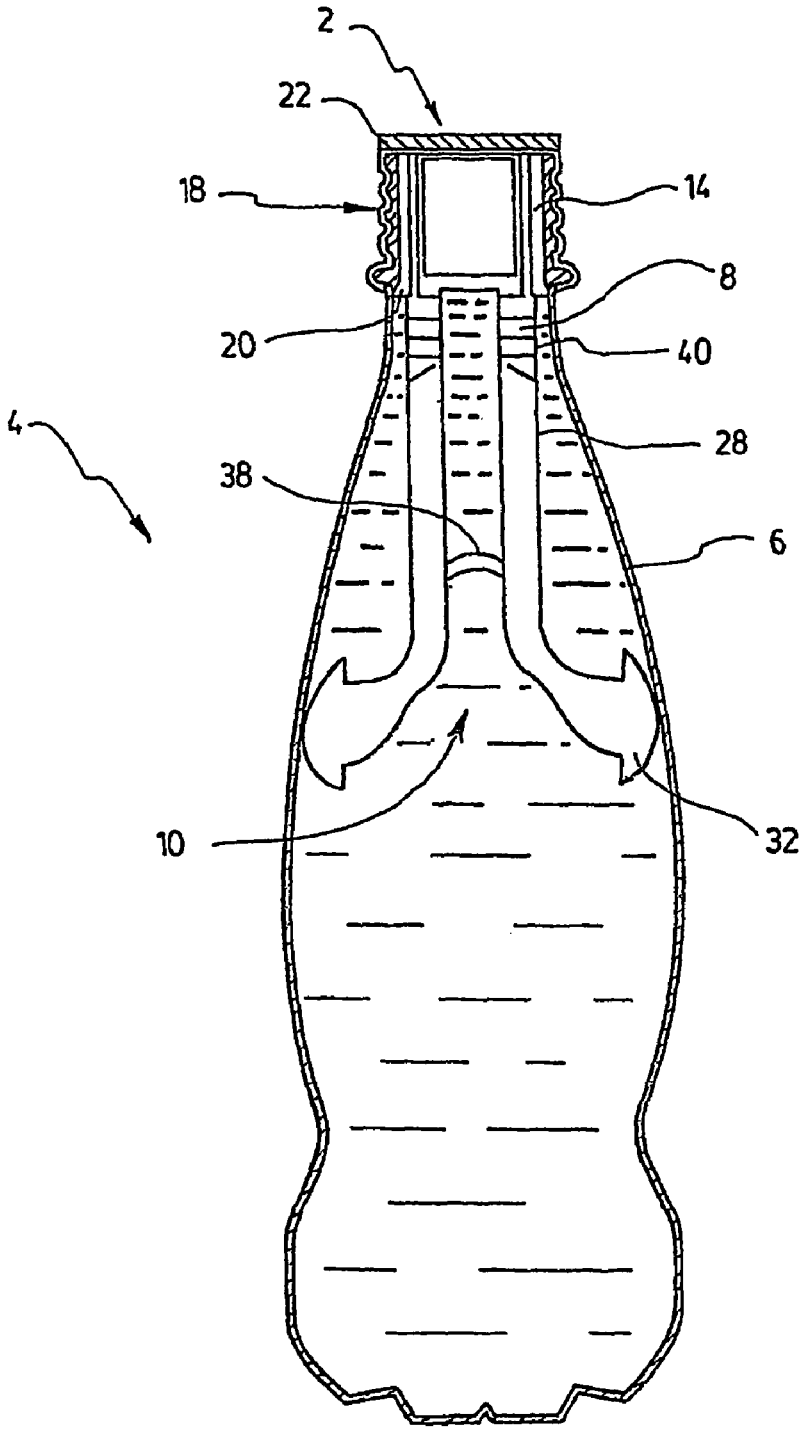
FIG. 1 is a side view of a first preferred embodiment of the invention in relation to a bottle in a first operating position.
Figure 2:
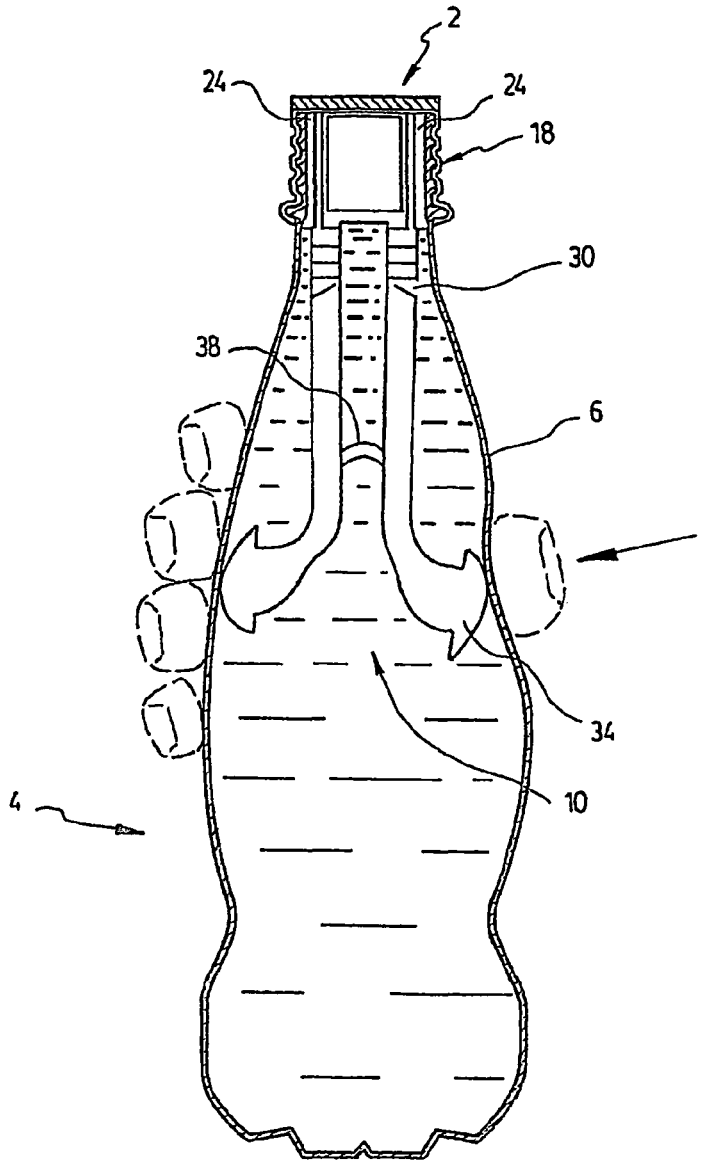
FIG. 2 is a view of the elements shown on FIG. 1 in a second operating position, in relation to the fingers of a user.
Figure 3:
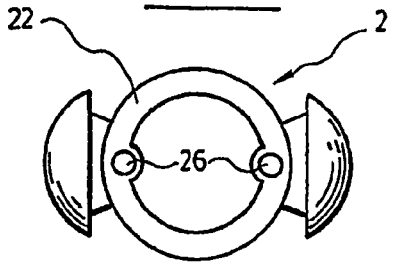
FIG. 3 is a top view of the embodiment shown on FIG. 1.
Figure 4:
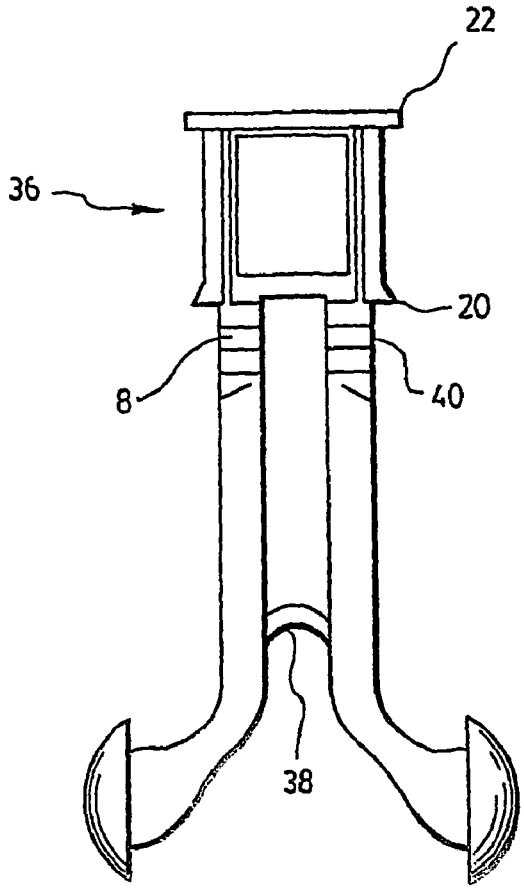
FIG. 4 is a side view of the embodiment shown on FIGS. 1 and 2.

If one refers now to FIGS. 1, 2 and 3, there is shown a device for a container 4 provided with an opening and a flexible wall 6, which comprises at least one tank 8 insertable into the container 4 in operating portion. The device comprises also at least one release mechanism 10 insertable into the container 4 in operating position. The release mechanism 10 is capable of cooperating with the tank 8 in order to connect the tank 8 with the interior of the container 4 in response to a pressure exerted on the release mechanism 10 via the flexible wall 6 of the container 4. The device also comprises a support means 14 insertable into the container 4 to support in operating position the tank 8 and the release mechanism 10 in relation to the container 4. The support means 14 has a fastener to fix it on the container 4 close to the opening. Preferably, the support means is made of a flexible material so that, when necessary, the device can be deformed to be inserted in the container 4 through its opening.

FIGS. 1 and 2 show a preferred embodiment where the device is in combination with a bottle having a threaded neck 18 and characterized in that the fastener comprises an annular bulge 20 capable of cooperating with a lower edge of the neck 18 and a collar 22 capable of cooperating with a superior edge of neck 18. The bulge 20 and the collar 22 make it possible to fix the support means 14 on the container 4. The support means 14 comprises a conduit 24 allowing to connect the tank 8 with an opening for filling 26 adjacent, in operating position, to the superior edge of neck the 18. This opening for filling 26 will allow to fill the tank 8 before or after the installation of the device inside the container 4. The annular bulge 20 and the collar 22 allow to ensure a stable assembly of the device inside the neck 18.

Preferably, the release mechanism 10 consists of an elongated section 28 having a first end connected to a weakened section 30 of the tank 8 and whose rupture is capable of connecting the tank 8 with the interior of the container 4, and a second end 32 adjacent, in operating position, with the flexible wall 6 of the container 4 to receive the pressure exerted via the wall 6 of the container 4. In FIG. 2, one sees the release mechanism 10 which is activated by the pressure exerted via the flexible wall 6 of the container 4 and which causes the rupture of the weakened zone 30.

Preferably, at the time of the use of the device with a container 4 whose wall 6 is transparent, the second end 32 of the elongated section 28 comprises a button 34 of a partially spherical shape, visible through the wall 6 of the container 4.

Referring to FIGS. 4 to 9, the device for container 4 according to the present invention can comprise, preferably, between two and four tanks. Of course, the number of tanks is not limited to four. According to these other preferred embodiments, the number of releases mechanisms 10 is equal to the number of tanks 8, these releases mechanisms 10 being capable of cooperating respectively with the tanks 8. The support means 14 is for supporting in operating position said tanks 8 and said releases mechanisms 10 in relation to the container 4.

Figure 6:
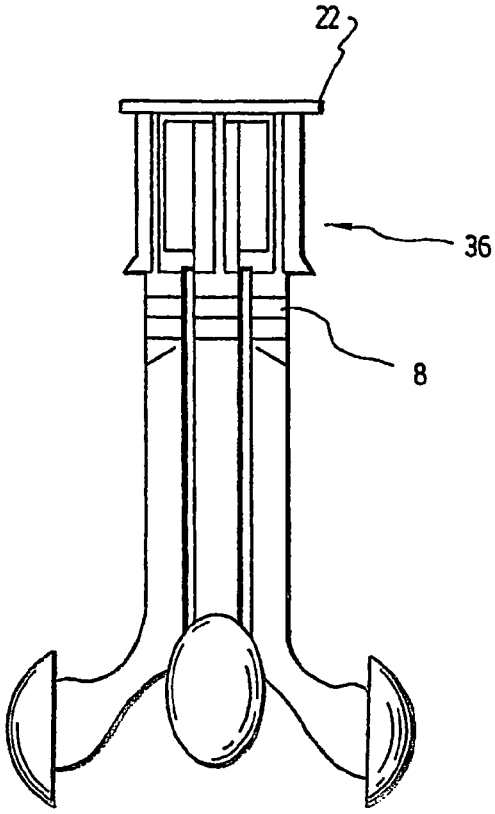
FIG. 6 is a side view of a second preferred embodiment of the invention.
Figure 7:
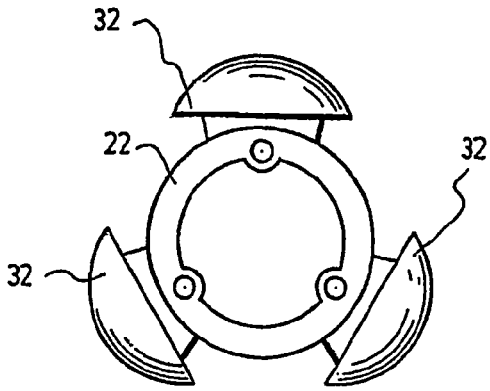
FIG. 7 is a top view of the embodiment shown on FIG. 6.
Figure 8:
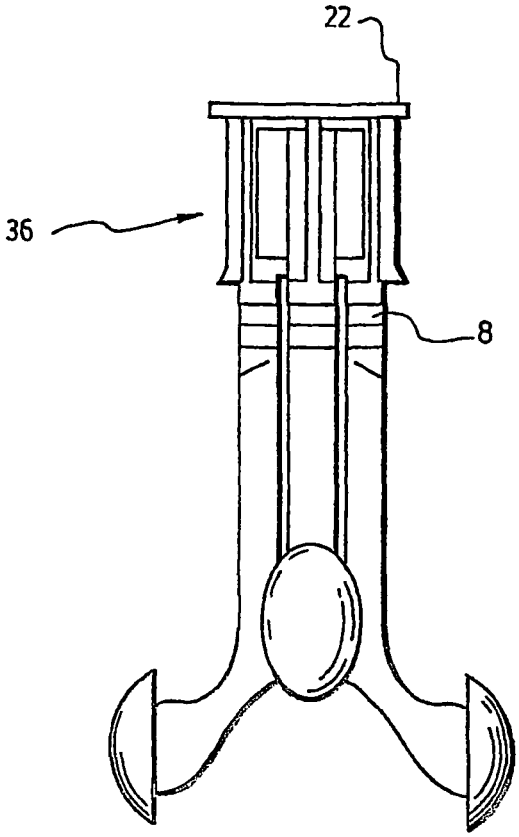
FIG. 8 is a side view of a third preferred embodiment of the invention.
Figure 9:
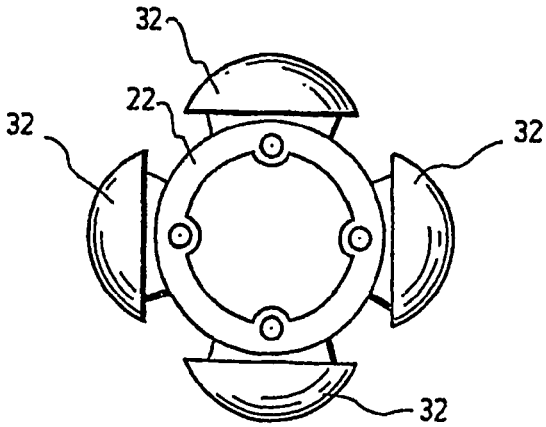
FIG. 9 is a top view of the embodiment shown on FIG. 8.
Figure 10:
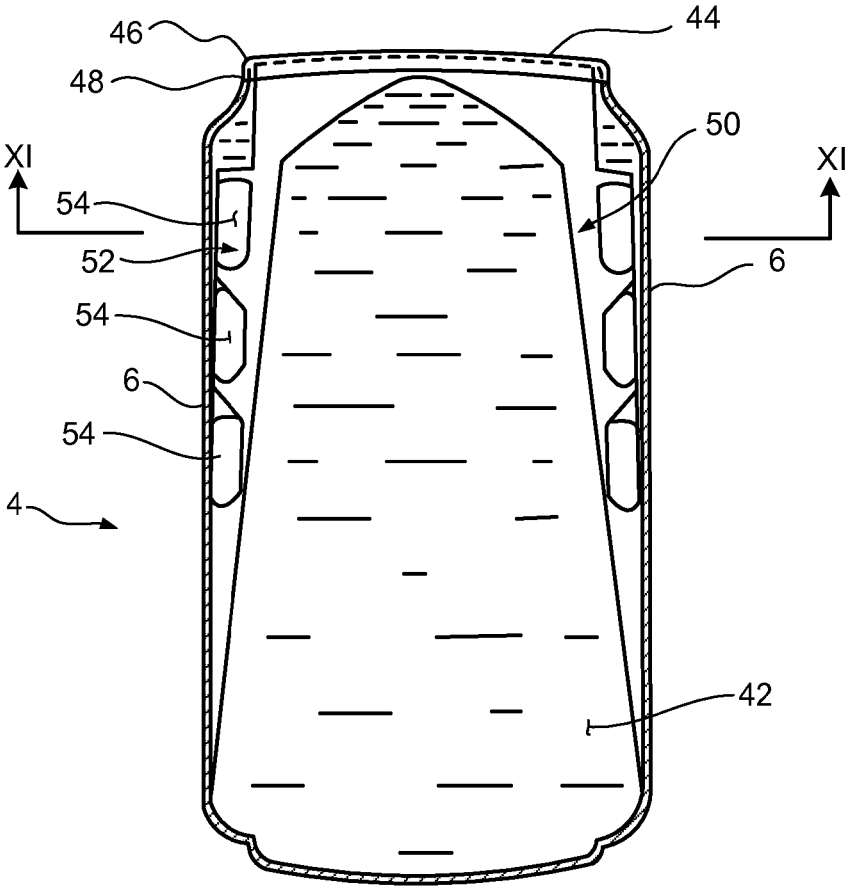
FIG. 10 is a side view of a fourth preferred embodiment of the invention, in relation to a can.
Figure 11:
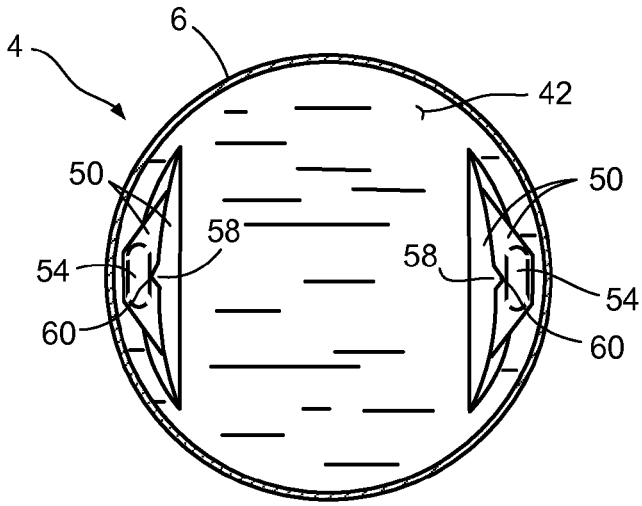
FIG. 11 is a view along line XI-XI shown on FIG. 10.
Figure 12:
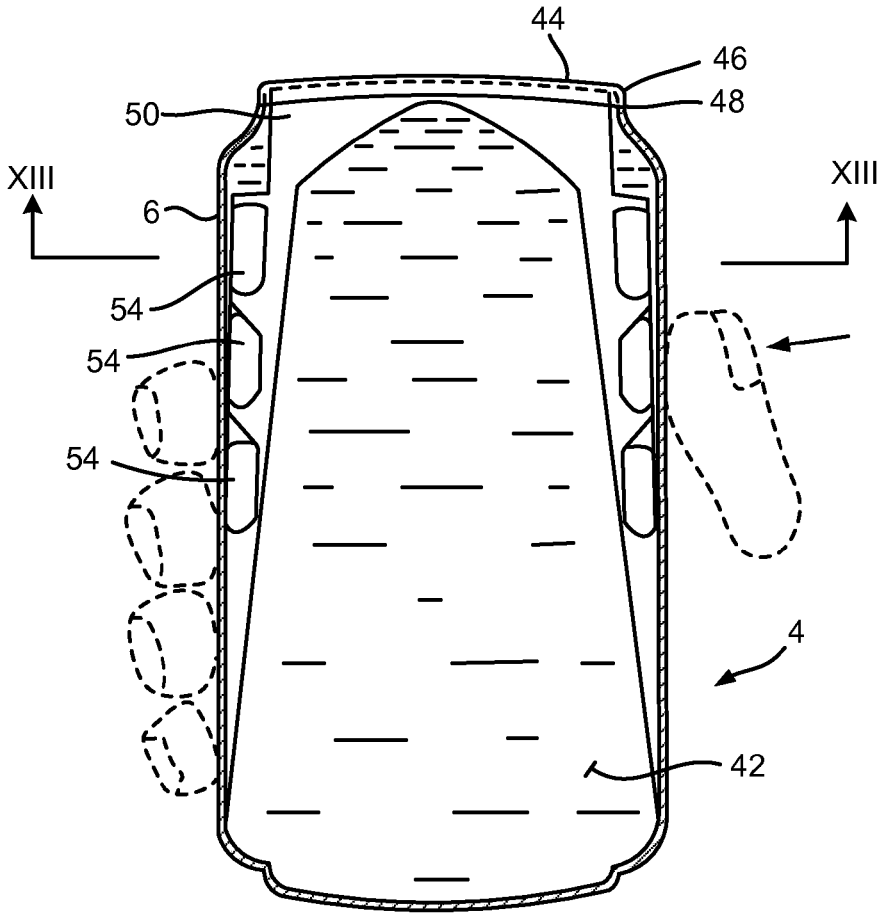
FIG. 12 is a view of the elements shown on FIG. 10, in relation to the fingers of a user.
Figure 13:
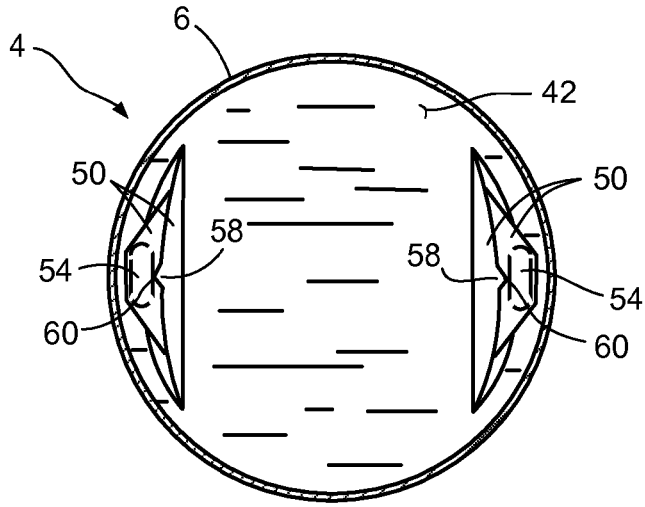
FIG. 13 is a view along line XIII-XIII shown on FIG. 12.

Preferably, the release mechanisms 10 each consist of an elongated section 28 having a first end connected respectively to a weakened section 30 on the corresponding tank 8 whose rupture is capable of connecting the corresponding tank 8 with the interior of the container 4, and a second end 32 adjacent, in operating position, with the flexible wall 6 of the container 4 to receive the pressure exerted via the flexible wall 6 of the container 4. More particularly, FIGS. 6 and 7 show us a device with three tanks 8 and three corresponding release mechanisms 10, and FIGS. 8 and 9 show us a device having four tanks 8 and four corresponding release mechanisms 10. The devices having more than one tank are characterized in that the release mechanisms 10 are connected between them by a return element 38 to exert a return force on the release mechanisms 10 towards a home position.

Figure 5:
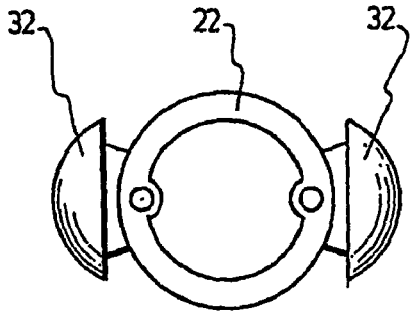
FIG. 5 is a top view of the embodiment shown on FIG. 4.

Preferably, referring now more particularly to FIGS. 5, 7 and 9, the device comprising more than one tank 8 is characterized in that the release mechanisms 10 are distributed, in operating position, regularly along the flexible wall 6 of the container 4. The tanks 8 are preferably provided with a translucent wall comprising graduations to make it possible to check a filling level of each tank 8. The graduations allow the user to control the quantity of the secondary product which he wishes to extract from each tank 8 to mix with the primary product inside the container 4.

According to another preferred embodiment, referring now to FIGS. 10 to 15, it is shown a device for a container 4 which is a can having a body 42 and a lid 44, characterized in that the fastener comprises an border 46 capable of cooperating with a higher edge 48 of the body 42 of the can, the border 46 allowing to fix the support means 50 on the container 4. On FIGS. 14 and 15, one can see that the support means 50 comprises at least one housing 52 to place at least one tank 54 which, in operating position, is adjacent with the flexible wall 6 of the can. According to this embodiment, said tank 54 comprises a preferable flexible wall 56.

Preferably, the device for the can is characterized in that the release mechanism consists of a tooth 58 having a first end fixed by support means 50 and a second blunt end 60 adjacent to the tank 54 to perforate the tank 54 and to connect it with the interior of the container 4 when said pressure is exerted. The device for the can is characterized in that it comprises six tanks capable of being perforated by six distinct releasing mechanisms capable of cooperating respectively with the tanks 54. The support means 50 is for supporting in operating position the tanks 54 and the release mechanisms in relation to the container 4.

Preferably, the release mechanisms each consist of a tooth 58 having a first end fixed by support means 50 and a second blunt end 60 adjacent to the corresponding tank 54 to perforate said corresponding tank 54 and to connect it with the interior of container 4 when said pressure is exerted.

Figure 15:
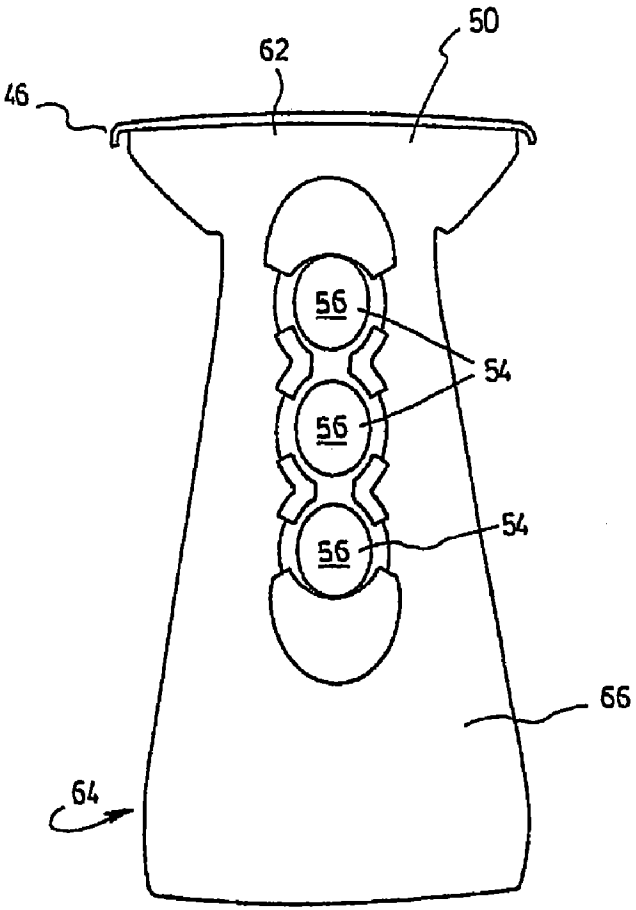
FIG. 15 is a front view of the embodiment shown on the FIG. 14.
Figure 14:
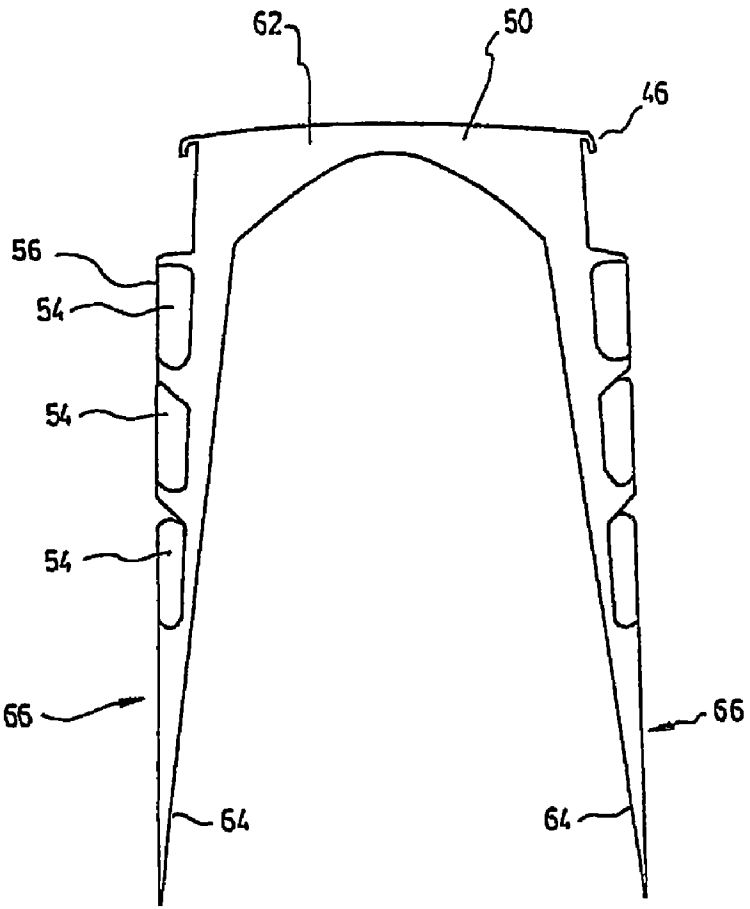
FIG. 14 is a side view of the embodiment shown on FIGS. 10, 11, 12 and 13.

Preferably, referring now more particularly to FIGS. 14 and 15, the device for the can is characterized in that the support means 50 consists of an arc 62 comprising two opposite jambs 64 and having each one an internal surface and an external surface 66. The support means 50 comprises at least one housing 52 which is located on the external surface 66 of each jamb 64. The arc 62 is flexible in order to exert a return force on the two jambs 64 towards a home position, and to be insertable in the body 42 of the can.

The present invention is for adding value to the containers and, particularly but not exclusively, to the containers for the beverages presented in plastics bottles, aluminium cans or boxes of paperboard, for example.

Although the invention is aiming a multitude of applications and industries such as the pharmaceutical industry, the cosmetic industry or the chemical industry, etc, the drinks industry would profit more from this invention.

The present invention refers to containers for beverages, or for other ends having the characteristic to possess a principal compartment represented by the container 4 and at least a secondary compartment represented by the tank 8 which, with an opening mechanism, allow the mixture of a primary substance with one or many secondary substances.

The invention comprises a principal compartment to contain a first product and a secondary compartment to contain a second product. This secondary compartment has a common wall with the principal compartment and means accessible from the outside of the container to create an opening in the common wall and thus to release the second product inside the principal compartment.

A standard container, such as for example the bottle in PET (polyethylene terephtalate) of a soft drink or the aluminium can of a juice, will be used by way of principal compartment and receiver (female part). It matters that this container did not undergo any modification. An addition is then carried out to the container; it is the innovation. The addition is used as a support to one or many secondary compartments and is provided with means allowing the opening or the breaking of the partitions. This addition is inserted in the principal container to form a unit with this last (male part). The receiving container is equipped with a top, a side and a bottom. Once that the addition is inserted and retained in places into correct alignment by a design simple and adapted to the container, the operation of the new container goes as follows. The container from now on is composed of a principal compartment and a secondary compartment. The container also comprises means, accessible from outside, to create an opening in a wall common to both compartments. The principal compartment can be of variables form and volume and be manufactured of any type of material (aluminium, plastic, paperboard, glass, steel, alloy, etc). It can also contain a product gasified or not or substances of pharmaceutical or cosmetic character. In this principal compartment the addition is incorporated and, by the very fact, a release device corresponding to the release mechanism of the description, allowing the opening, the closing or the breaking of one or several waterproof compartments and to release the secondary ingredient or ingredients in the product or the primary ingredient. The release device inside the primary container becomes accessible from outside by a pressure of the hand to the indicated place. By doing this, the elasticity of the wall of the principal container, in pressure and in depression, allows the reach of the intern mechanism and thus allows to operate the opening, the closing or the breaking of the common wall. The secondary ingredients can take the shape of a liquid, of a powder or of a solid and their states can vary.

The secondary ingredient or ingredients thus released in the primary ingredient, in a controlled way or not, will allow to the user to modify the product as for its flavour, its odour or any other characteristic. For example, the addition and the mixing of the secondary ingredient or ingredients could modify the flavour of the primary ingredient while turning it more or less spicy, salted, sweetened, vigorous, alcoholic, with lime flavour, etc. This procedure could also allow modifying the odour of a scented solution, the color of a dyeing, the colour of a cosmetic, the vitamin concentration of a drink, etc.

The addition could contain several choices of flavours or other characteristics. We can thus find there several secondary ingredients contained in several distinct secondary compartments delimited by several waterproof bulkheads inside the same container. These partitions could be associated to the container in a rigid or partial way. They could be assembled to the principal container, such as for example a can, in order to have the shape of a slab and to facilitate the flow of the product, such as for example a drink, towards the tip. This would allow a more laminar pouring.

The button or buttons could be actuated before or after the opening of the container. In the case of soft drinks, internal pressure arranges it to reduce the elasticity of the wall when the container is still sealed. It is following the opening of the container that the mechanism is perfectly operational. Moreover, the transport of the gas bubbles causes an improvement of the homogeneity of the mixture. When the soft drinks are contained in a plastic bottle, the same situation prevails. On the other hand, the flow will only be possible when the air can enter by the filling orifices of the addition. The technique of liquid nitrogen introduction could create similar conditions for the food products without gas. It should be noted that the density of the product and its capacity of dissolution will have an impact on the quality of the homogeneity of the mixture. Moreover, in the case of the addition for the bottle, the level of the primary substance will have to be calculated in order to allow the flow of all the secondary substances before reaching the intersection of the opening of the secondary compartments.

The product can enter in all the houses of the world; its marketing thus represents a large volume. This innovation is accessible, economically simple, safe and easy to handle. The development costs are affordable and its creation will allow reducing the costs of the organization. The invention allows the consumer to take part in the manufacturing and selecting process.

It is a matter of the ultimate rational way to pursue the strategy of segmentation organized during the last years. The product will meet a need for identification for the various age groups, sex groups, etc. This innovation will make it possible to renew the production and to create a new enthusiasm in the market of the beverages and the distribution. This new type of container also profits from the same cycle of recycling as the primary container. It will be of simple design, robust and available facing the technology of today. Lastly, this new container offers inexhaustible possibilities in terms of setting in market.

The list of the uses to which the invention can apply is long. Without being exhaustive, it comprises:

the cola: nature or choice of flavour (vanilla, cherry, etc.) and adjustment of the intensity of the desired flavour and this, right before its consumption;

the mineral water: nature and offering a choice of flavour (lemon, lime, etc.) and adjustment of the intensity of this flavour;

vegetable or tomato juice: nature or spiced and adjustment of the desired intensity;

the tea: nature or lemon flavoured and selection of the intensity of flavour;

the beer: nature or tomato flavoured, accentuated cereal flavour or lime flavoured and selection of the intensity of the flavour;

the perfume: adjustment of the intensity of the emanations;

to maintain a gas separate from a liquid and injection at the favourable time, right before the use or consumption;

to maintain substances separated for handling and storage;

to associate reactive products at the moment of the use (e.g.: glue);

to allow the addition of therapeutic substances to a primary ingredient for the need of a treatment;

to allow the addition of a quantity of sugar in relation to the sugar rate of a patient;

to give the choice to a consumer to incorporate vitamin supplements or additives (calcium, for example) in a primary substance (Soya or cow's milk, for example);

to allow the mixture of substances right before the use, certain mixtures requiring it in order to improve the conservation;

etc.

The consumer keeps the full control while deciding to drink without modification the primary substance from the container or in a different container. He has the possibility of choosing, among the options which are offered to him, the flavour, the odour as well as the desired intensity and this, thanks to a simple pressure of the wall of the existing container. The mechanism considered makes it possible to the customers to preserve a perfect control of the quantities injected.

The other advantages associated with the invention are as follows:

give "wings" to all the branches of industry of the organization and the market in general: marketing, transport, production, purchase, handling, chemistry of the solutions, industrial engineering, etc;

to reinvent the way to drink;

to be in harmony with the current concepts of recycling;

to avoid major investments to make tests;

it is not toxic, anti-corrosive, transparent and aesthetic;

it is resistant to the normal impacts in relation to handling and storage;

the addition with the container is not permanent and could be sold separately, in particular in the case of the bottles in PET; and it does not deteriorate the current container.

One of the assets of the invention is to count on the very value of the existing container without changing anything in its appearance. Indeed, the invention does nothing but bring added value to the existing containers. It thus consists in the manufacture of an addition in an under-assembly mode which is then fixed in a simple way and adapted to the body of the container.

The efforts of innovation of the containers up to now were especially centered towards the development of more voluptuous forms, more fashionable colors, volumes better adapted to the circumstantial needs, of materials elaborated according to technological advance and this, in order to generate benefit of cost, of quality or of transport.

None of these innovations touches the functionality of the container. The evolutions of functionalities were especially concentrated towards the caps, the glue containers which can mix the two components of an epoxy, the sealed container to preserve freshness or to retain the pressure of a gas, the peppermill making it possible to crush its pepper to have it with wanted granulometry, the container under pressure with which it is possible to vaporize a product, the shoes wax container provided with a sponge allowing to wax the shoes directly.

Most of the time, the functionality was developed within sight of a single product inside the container. However, many products are resulting from the mixture from one or several other products. One of the alternatives of the containers which could be marketed in the future could make it possible to monopolize a part of the manufacturing process upstream while bringing benefit to the organization and to the customers who consume the good in question.

Certain mixtures cannot be prepared a long time in advance because of the lack of stability and of the fast degradation of the resulting substance. It is thus certain that because of this constraint some organizations working in the food, the pharmaceutical, the cosmetic or others industries put aside some products which could however be extremely interesting for the consumers. It would be possible to lengthen the lifespan of certain products offered already mixed by delaying the realization of the mixture right before its use or its consumption.

The present invention allows anticipating many benefits and technological advantages. Initially, an addition which is of a great effectiveness, safe and robust, made of the same material as the principal container and allowing the same recycling mode as the receiving container. This addition can be manufactured in an under-assembly and be incorporated in the current assembly lines for an installation in one step. This addition will be also articulated in order to be able to carry out various doses. Lastly, this addition does not require any modification to the principal container.

This new addition offers possibilities which were not exploited until now. It can create value to a given product. Moreover, the benefits are very interesting for the consumer.

The addition makes it possible to offer to the consumers, in a single container, the possibility of choosing the flavour which they prefer at the very last moment. It also makes it possible to adjust the intensity of the flavour according to specific requirements of each individual so that each consumer produces the taste which he likes most.

Who wouldn't like to be in measure to adjust the syrup of his preferred cola to the desired intensity? Several people have the impression that the taste of the large sizes is more diluted.

Moreover, according to the selection of the dishes as well as the hour to which a meal is taken, it would be pleasant to have this possibility of modifying the flavour of a drink in relation to dishes with more or less pronounced tastes. A little as one adjusts the choice of a wine according to the more or less pronounced taste of a cheese.

Important thing, the benefits already offered by the container without the addition according to the present invention, are not affected. The consumer always has the possibility of consuming only the primary product, of drinking or not from the container, etc. Actually, the addition according to the present invention allows, on a point of information, to reinvent our way of drinking.

One of the major advantages of this invention would be to make it possible to the operating organization to profit from a lever without precedent enabling it to increase its sales by a renewed marketing. Moreover, it would profit from important reductions of cost by withdrawing from the production process all the complexity coming from the operations and management of the production of all its flavours.

The chemists could set loose their creativity to create components to be incorporated in the secondary containers, integral parts of the addition.

The industry of the beverages will be able to offer more personalized products and offering the possibility to the consumer to personalize his beverage himself. This second option is the best, because it meets the immediate needs for the consumers rather than to attack multiple supplies or demands.

The quality of materials used up to now for the manufacture of the current containers was tested billion times. The materials used to manufacture the addition are of comparable nature and of robust construction. The scope of the invention arranges that to reduce the possibilities of substitution.

The principal products used for the bottling of drinks are the aluminium, the glass and the plastic. However, the recent technological developments support the growing use of the plastic. Until recently, only PVC (polyvinyl chloride) was used for the bottling of soft drink. Its lightness and its low cost are two assets militant in his favour. Unfortunately, it is not completely tight to the passage of $CO_2$ and $O_2$. That causes to reduce the time of conservation of the products on the shelves. Thus, PVC is usable for soft drinks, but unacceptable for beer and this is why the containers of aluminium and glass are still used.

For a few years, the PET has made its entry and replaces the PVC more and more, because it is superior. It is 20% lighter, as transparent as glass, unbreakable, easy to manufacture and easy to recycle. Moreover, it affects less the environment than the other containers. It is also much tighter with $CO_2$ and of $O_2$ then the PCV, what multiplies by three (and up to twenty) the lifespan of soft drinks. Current R&D work aims to increase this sealing until it reaches that of glass. Thus the containers in PET could be used for beer and wine. Finally, the PET is less expensive than PVC. The PET thus seems the plastic of the future for bottling. However, its use requires very thorough technological knowledge. The bottles currently on the market are the result of important investments (about 150 million dollars CDN) in R&D.

Though the present invention was described above by way of preferred embodiment, such preferred embodiment can, of course be modified at will while remaining inside the field defined by the claims annexed without changing or affecting the nature or the extent of this invention.

What is claimed is:

1. A container for allowing the release of a first substance into a second substance, said container comprising in combination:

a can for containing the second substance provided with an opening at its top end and a lateral flexible wall;

a support insertable in the can for supporting at least one tank containing the first substance within the can adjacent to the inner surface of the can flexible wall;

a fastener to fix the support on the can top end; and at least one tooth having a first end fixed to the support and a second blunt end abutting at least one tank, said tooth second end engaging and perforating at least one tank in response to a lateral force exerted on an outside area of the can flexible wall that moves the tooth second end relative to at least one tank to engage and perforate at least one tank, thereby releasing the first substance contained within the tank into the second substance contained within the can.

2. A container according to claim 1, wherein the support is made of a material comprising at least one of metal, plastic, paperboard, glass and an alloy of metal.

3. A container according to claim 1, wherein the fastener comprises a border at the can top end for cooperating with a superior edge of the can to fix the support on the can close to its opening.

4. A container according to claim 1, wherein the support comprises two opposite jambs formed as an arc and having an internal surface and an external surface facing the inner surface of the can flexible wall.

5. A container according to claim 4, wherein said at least one tank is located on the external surface of a jamb.

6. A container according to claim 4, wherein the jambs forming the arc are flexible to exert a return force on the two jambs towards a home position.

7. A container according to claim 1, wherein:

said at least one tank comprises six tanks; and said at least one tooth comprises six teeth, each one of the teeth being capable of perforating respectively a corresponding one of a said at least one tank.

8. A container according to claim 1, wherein the support is of a flexible material.

9. A container according to claim 5, wherein there are a plurality of tanks on each jamb.

10. A container according to claim 8, further comprising a respective tooth opposing each of said tanks to engage a respective tank.

* * * * *